US009324536B2

(12) United States Patent
Greenland et al.

(10) Patent No.: US 9,324,536 B2
(45) Date of Patent: Apr. 26, 2016

(54) DUAL-ENERGY X-RAY TUBES

(75) Inventors: Kasey Otho Greenland, Salt Lake City, UT (US); James Russell Boye, Salt Lake City, UT (US)

(73) Assignee: VARIAN MEDICAL SYSTEMS, INC., Palo Alto, CA (US)

( * ) Notice: Subject to any disclaimer, the term of this patent is extended or adjusted under 35 U.S.C. 154(b) by 481 days.

(21) Appl. No.: 13/251,027

(22) Filed: Sep. 30, 2011

(65) Prior Publication Data

US 2013/0083899 A1 Apr. 4, 2013

(51) Int. Cl.
*H01J 35/06* (2006.01)
*H01J 35/08* (2006.01)

(52) U.S. Cl.
CPC ..... *H01J 35/08* (2013.01); *H01J 35/06* (2013.01); *H01J 2235/068* (2013.01)

(58) Field of Classification Search
CPC ..... H01J 35/06; H01J 35/08; H01J 35/10; H01J 2235/068
USPC ..... 378/5, 16, 98.9, 98.11, 134
See application file for complete search history.

(56) References Cited

U.S. PATENT DOCUMENTS 4,823,371 A * 4/1989 Grady ..... 378/134
5,511,105 A * 4/1996 Knott ..... 378/134
5,563,923 A * 10/1996 Okada ..... H01J 35/14 378/138
5,898,755 A * 4/1999 Meusel et al. ..... 378/137
6,055,294 A * 4/2000 Foerst et al. ..... 378/138
6,091,799 A * 7/2000 Schmidt ..... 378/137
6,104,781 A * 8/2000 Buchmann ..... 378/101
6,111,934 A * 8/2000 Foerst ..... H01J 35/30 378/121
6,128,367 A * 10/2000 Foerst et al. ..... 378/137
6,333,969 B1 * 12/2001 Kujirai ..... 378/138
6,487,273 B1 * 11/2002 Takenaka et al. ..... 378/142
6,556,654 B1 * 4/2003 Hansen et al. ..... 378/101
6,674,838 B1 * 1/2004 Barrett ..... H01J 35/106 378/125
6,952,464 B2 * 10/2005 Endo ..... 378/98.11
7,058,160 B2 * 6/2006 Boye ..... H01J 35/10 378/125
7,065,179 B2 * 6/2006 Block et al. ..... 378/134
7,085,354 B2 * 8/2006 Kanagami ..... 378/136
7,120,222 B2 * 10/2006 Hoffman ..... 378/5
7,127,031 B2 * 10/2006 Endo ..... 378/98.11
7,127,034 B1 * 10/2006 Lee et al. ..... 378/131
7,386,089 B2 * 6/2008 Endo et al. ..... 378/5
7,466,799 B2 * 12/2008 Miller ..... H01J 35/16 378/121
7,529,344 B2 * 5/2009 Oreper ..... 378/134
7,792,241 B2 * 9/2010 Wu et al. ..... 378/16
7,852,979 B2 * 12/2010 Edic et al. ..... 378/16

(Continued)

FOREIGN PATENT DOCUMENTS

WO 2007/142999 A2 12/2007
WO 2010/024821 A1 3/2010
WO 2011/053972 A2 5/2011

OTHER PUBLICATIONS

Extended European Search Report dated Jan. 2, 2014 received in related European Patent Application No. 12186491.2.

*Primary Examiner* — Allen C. Ho
(74) *Attorney, Agent, or Firm* — Maschoff Brennan

(57) ABSTRACT

Dual-energy x-ray tubes. In one example embodiment, a dual-energy x-ray tube includes an evacuated enclosure, an anode positioned within the evacuated enclosure, a first cathode positioned within the evacuated enclosure, and a second cathode positioned within the evacuated enclosure. The first cathode and the second cathode are configured to operate simultaneously at different voltages.

19 Claims, 4 Drawing Sheets

(56) References Cited

U.S. PATENT DOCUMENTS

| | | | | |
|---|---|---|---|---|
| 7,881,425 | B2 * | 2/2011 | Vermilyea et al. | 378/19 |
| 8,054,944 | B2 * | 11/2011 | Freudenberger et al. | 378/134 |
| 8,396,185 | B2 * | 3/2013 | Zou et al. | 378/16 |
| 8,571,181 | B2 | 10/2013 | Charette et al. | |
| 8,750,458 | B1 * | 6/2014 | Wang | H01J 3/023 378/122 |
| 2010/0104062 | A1 | 4/2010 | Wu et al. | |
| 2011/0188625 | A1 | 8/2011 | Roshi et al. | |

* cited by examiner

DUAL-ENERGY X-RAY TUBES

BACKGROUND

X-ray tubes are extremely valuable tools that are used in a wide variety of applications, both industrial and medical. An x-ray tube typically includes a cathode and an anode positioned within an evacuated enclosure. The cathode includes an electron emitter and the anode includes a target surface that is oriented to receive electrons emitted by the electron emitter. During operation of the x-ray tube, an electric current is applied to the electron emitter, which causes electrons to be produced by thermionic emission. The electrons are then accelerated toward the target surface of the anode by applying a high-voltage potential between the cathode assembly and the anode. When the electrons strike the anode target surface, the kinetic energy of the electrons causes the production of x-rays. The x-rays are produced in an omnidirectional fashion where the useful portion ultimately exits the x-ray tube through a window in the x-ray tube, and interacts with a material sample, patient, or other object with the remainder being absorbed by other structures including those whose specific purpose is absorption of x-rays with non-useful trajectories or energies.

During the operation of a typical x-ray tube, electrons are produced at a single energy resulting in x-rays having a distribution of energies with a mean value, herein referred to as x-ray energy. While having one x-ray energy is useful, in some situations it would be desirable to examine a material sample, patient, or other object with x-rays having different x-ray energies. For example, x-rays having multiple energies would be useful in baggage scanning applications where attempts are made to detect materials of different densities.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY OF SOME EXAMPLE EMBODIMENTS

In general, example embodiments relate to dual-energy x-ray tubes. The example dual-energy x-ray tubes disclosed herein include two cathodes configured to emit electrons at different energies resulting in the generation of x-rays at different energies. Among other things, the generation of x-rays having different energies from a single x-ray tube can be useful in applications where attempts are made to detect materials of different densities.

In one example embodiment, a dual-energy x-ray tube includes an evacuated enclosure, an anode positioned within the evacuated enclosure, a first cathode positioned within the evacuated enclosure, and a second cathode positioned within the evacuated enclosure. The first cathode and the second cathode are configured to operate simultaneously at different voltages.

In another example embodiment, a dual-energy x-ray tube includes an evacuated enclosure, an anode positioned within the evacuated enclosure, a first cathode positioned within the evacuated enclosure, and a second cathode positioned within the evacuated enclosure. The anode is configured to operate at a positive high voltage. The first cathode is configured to operate at a negative high voltage. The second cathode is configured to operate at about zero voltage. The first cathode and the second cathode are configured to continuously operate simultaneously.

In yet another example embodiment, a dual-energy x-ray system includes a high-voltage generator configured to continuously generate a single positive high voltage and a single negative high voltage and an x-ray tube. The x-ray tube includes an evacuated enclosure, an anode positioned within the evacuated enclosure, a first cathode positioned within the evacuated enclosure, and a second cathode positioned within the evacuated enclosure. The anode is configured to operate at the single positive high voltage. The first cathode is configured to operate at the single negative high voltage. The second cathode is configured to operate at about zero voltage. The first cathode and the second cathode are configured to continuously operate simultaneously.

These and other aspects of example embodiments of the invention will become more fully apparent from the following description and appended claims.

BRIEF DESCRIPTION OF THE DRAWINGS

To further clarify certain aspects of the present invention, a more particular description of the invention will be rendered by reference to example embodiments thereof which are disclosed in the appended drawings. It is appreciated that these drawings depict only example embodiments of the invention and are therefore not to be considered limiting of its scope. Aspects of example embodiments of the invention will be described and explained with additional specificity and detail through the use of the accompanying drawings in which.

DETAILED DESCRIPTION OF SOME EXAMPLE EMBODIMENTS

Example embodiments of the present invention relate to dual-energy x-ray tubes. Reference will now be made to the drawings to describe various aspects of example embodiments of the invention. It is to be understood that the drawings are diagrammatic and schematic representations of such example embodiments, and are not limiting of the present invention, nor are they necessarily drawn to scale.

1. First Example Dual-Energy X-Ray Tube

Figure 1A:
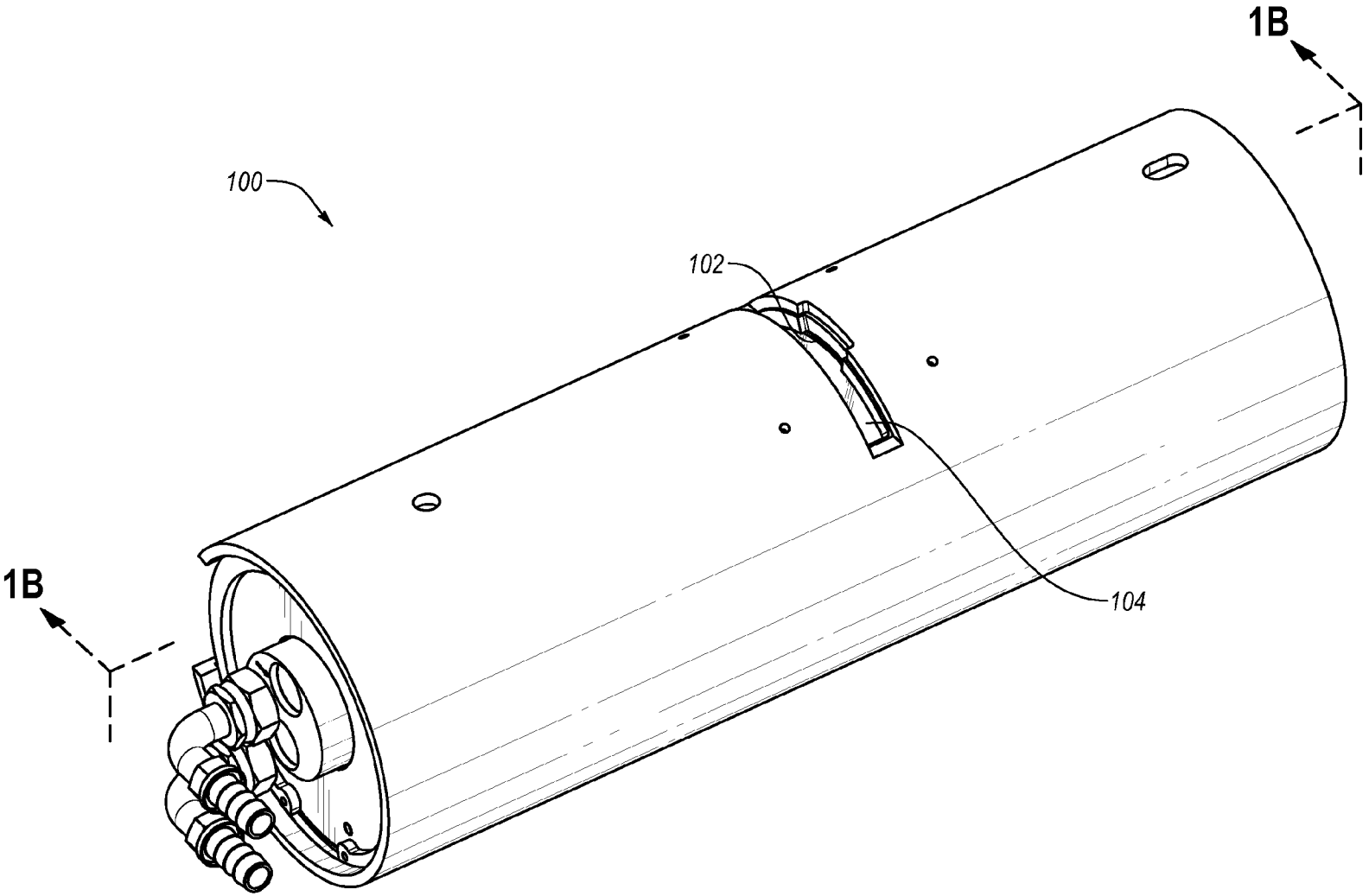
FIG. 1A is a perspective view of an example x-ray tube.
Figure 1B:
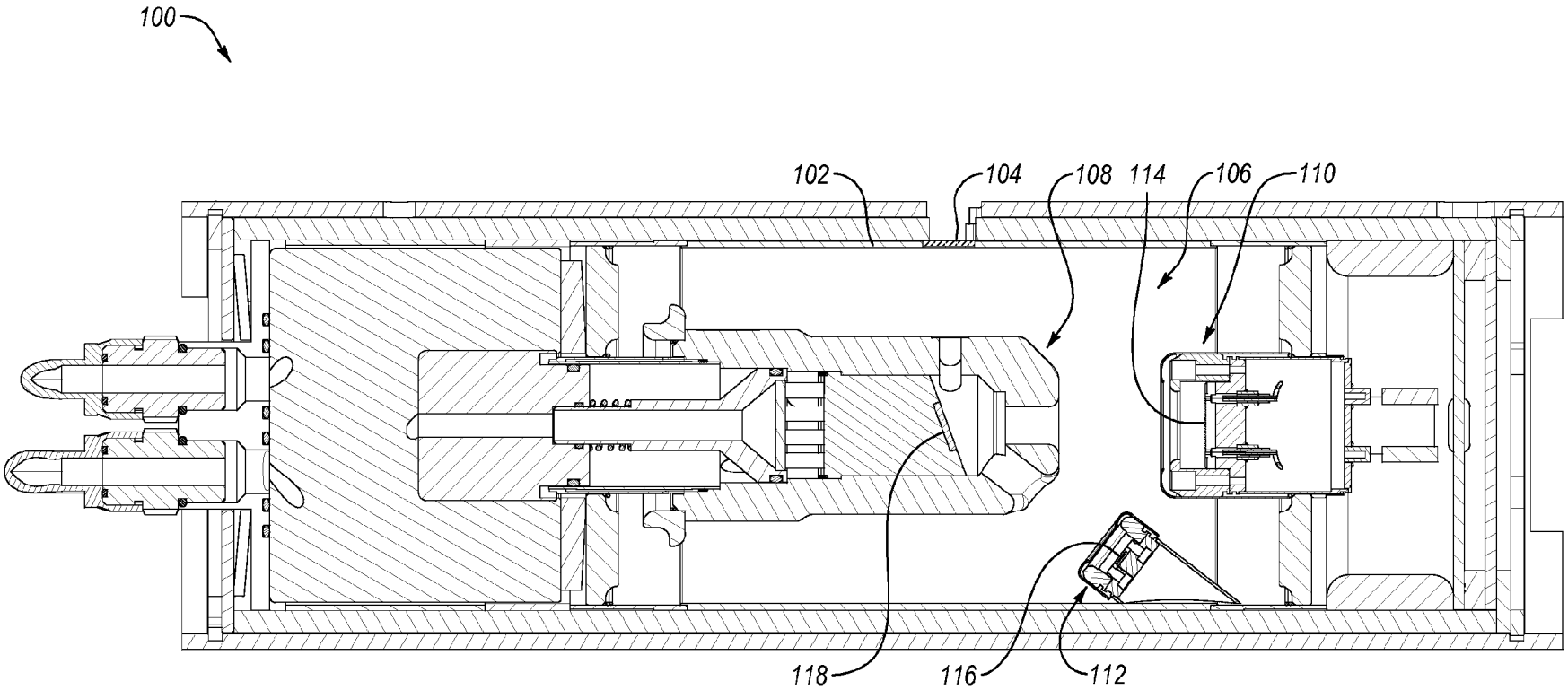
FIG. 1B is a cross-sectional side view of the example x-ray tube of FIG. 1A.

With reference first to FIGS. 1A and 1B, a first example dual-energy x-ray tube 100 is disclosed. As disclosed in FIG. 1A, the example dual-energy x-ray tube 100 generally includes a can 102 and an x-ray tube window 104 attached to the can 102. The x-ray tube window 104 is comprised of an x-ray transmissive material, such as beryllium or other suitable material(s). The can 102 may be formed from stainless steel, such as 304 stainless steel.

As disclosed in FIG. 1B, the x-ray tube window 104 and the can 102 at least partially define an evacuated enclosure 106 within which an anode 108, a first cathode 110, and a second cathode 112 are positioned. More particularly, the first and second cathodes 110 and 112 extend into the can 102 and the anode 108 is also positioned within the can 102. The anode 108 is spaced apart from and oppositely disposed to the cathodes 110 and 112.

The anode 108 and the first cathode 110 are connected in a first electrical circuit that allows for the application of a first high voltage potential between the anode 108 and the first cathode 110. Similarly, the anode 108 and the second cathode 112 are connected in a second electrical circuit that allows for the application of a second high voltage potential between the anode 108 and the second cathode 112. In order to create x-rays at dual energies, the anode 108 is configured to operate at a positive high voltage, the first cathode 110 is configured to operate at a negative high voltage, and the second cathode 112 is configured to operate at about zero voltage. Thus, the anode 108 and the first cathode 110 are both electrically insulated from about ground, while the second cathode 112 is not electrically insulated from about ground and thus requires no high-voltage stand-off.

With continued reference to FIG. 1B, prior to operation of the example dual-energy x-ray tube 100, the evacuated enclosure 106 is evacuated to create a vacuum. Then, during operation of the example dual-energy x-ray tube 100, a positive high voltage is electrically applied to the anode 108 while a negative high voltage is electrically applied to the emitters 114 of the first cathode 110 and an about ground voltage is electrically applied to the emitters 116 of the second cathode 112 to cause electrons to be emitted from the cathodes 110 and 112 by thermionic emission. The application of high voltage differentials between the anode 108 and the cathodes 110 and 112 then causes the electrons to accelerate from the cathodes 110 and 112 toward a focal spot of a target 118 that is positioned on the anode 108. The target 118 may be composed for example of tungsten or other material(s) having a high atomic ("high Z") number. As the electrons accelerate, they gain a substantial amount of kinetic energy, and upon striking the focal spot on the target 118, some of this kinetic energy is converted into x-rays.

The target 118 is oriented so that many of the emitted x-rays are directed to the x-ray tube window 104. As the x-ray tube window 104 is comprised of an x-ray transmissive material, the x-rays emitted from the focal spot on the target 118 pass through the x-ray tube window 104 in order to image an intended target (not shown) to produce an x-ray image (not shown). The x-ray tube window 104 therefore hermetically seals the vacuum of the evacuated enclosure 106 of the dual-energy x-ray tube 100 from the atmospheric air pressure outside the dual-energy x-ray tube 100 and yet enables the x-rays generated by the anode 108 to exit the dual-energy x-ray tube 100.

As noted above, the cathodes 110 and 112 include emitters 114 and 116, respectively. The emitter 114 of the cathode 110 and the anode 108 are both configured to be electrically connected to an appropriate high-voltage generator (not shown). For example, a bi-polar high-voltage generator (not shown) may be configured to continuously generate a single positive high voltage and a single negative high voltage. The single positive high voltage can define the voltage potential of the anode 108 and the single negative high voltage can define the voltage potential of the cathode 110. An about ground voltage can define the voltage potential of the cathode 112. For example, the high-voltage generator (not shown) can be configured to produce a voltage potential on the anode 108 at a voltage between about 50 kV and about 320 kV and the first cathode 110 at a voltage between about −320 kV and about −50 kV.

In some example embodiments, the high-voltage generator (not shown) may be balanced such that the single positive high voltage is about opposite the single negative high voltage. For example, the anode 108 may be configured to operate at about 75 kV, the first cathode 110 may be configured to operate at about −75 kV, and the second cathode 112 may be configured to operate at 0 kV. This example results in the generation of x-rays at about 150 keV from the first cathode 110 and x-rays at about 75 keV from the second cathode 112. Thus, the operation of the second cathode 112 results in x-rays that are about half the energy of the x-rays that result from the operation of the first cathode 110.

In other example embodiments, the high-voltage generator (not shown) may be unbalanced such that the single positive high voltage is not opposite the single negative high voltage. For example, the anode 108 may be configured to operate at about 50 kV, the first cathode 110 may be configured to operate at about −100 kV, and the second cathode 112 may be configured to operate at 0 kV. This example results in the generation of x-rays at about 150 keV from the first cathode 110 and x-rays at about 50 keV from the second cathode 112. Thus, the operation of the second cathode 112 results in x-rays that are less than half the energy of the x-rays that result from the operation of the first cathode 110. It is understood that an unbalanced high-voltage generator (not shown) could alternatively be configured such that the operation of the second cathode 112 result in x-rays that are greater than half the energy of the x-rays that result from the operation of the first cathode 110. It is also noted that in this example the total voltage potential difference between the first cathode 110 and the anode 108 is equal to the previous example at 150 keV, while the voltage potential difference between the second cathode 112 and the anode 108 is reduced to 50 keV.

Since both the cathodes 110 and 112 can operate simultaneously, the dual-energy x-ray tube 100 is configured to generate x-rays at dual energies simultaneously or intermittently, with the energy of the x-rays produced by the first cathode 110 being higher than the energy of the x-rays produced by the second cathode 112. The dual-energy x-ray tube 100 can therefore be employed in connection with an x-ray detector, such as a flat-panel detector, that is specifically designed to simultaneously detect x-rays at each of the dual energies.

2. Second Example Dual-Energy X-Ray Tube

Figure 2A:
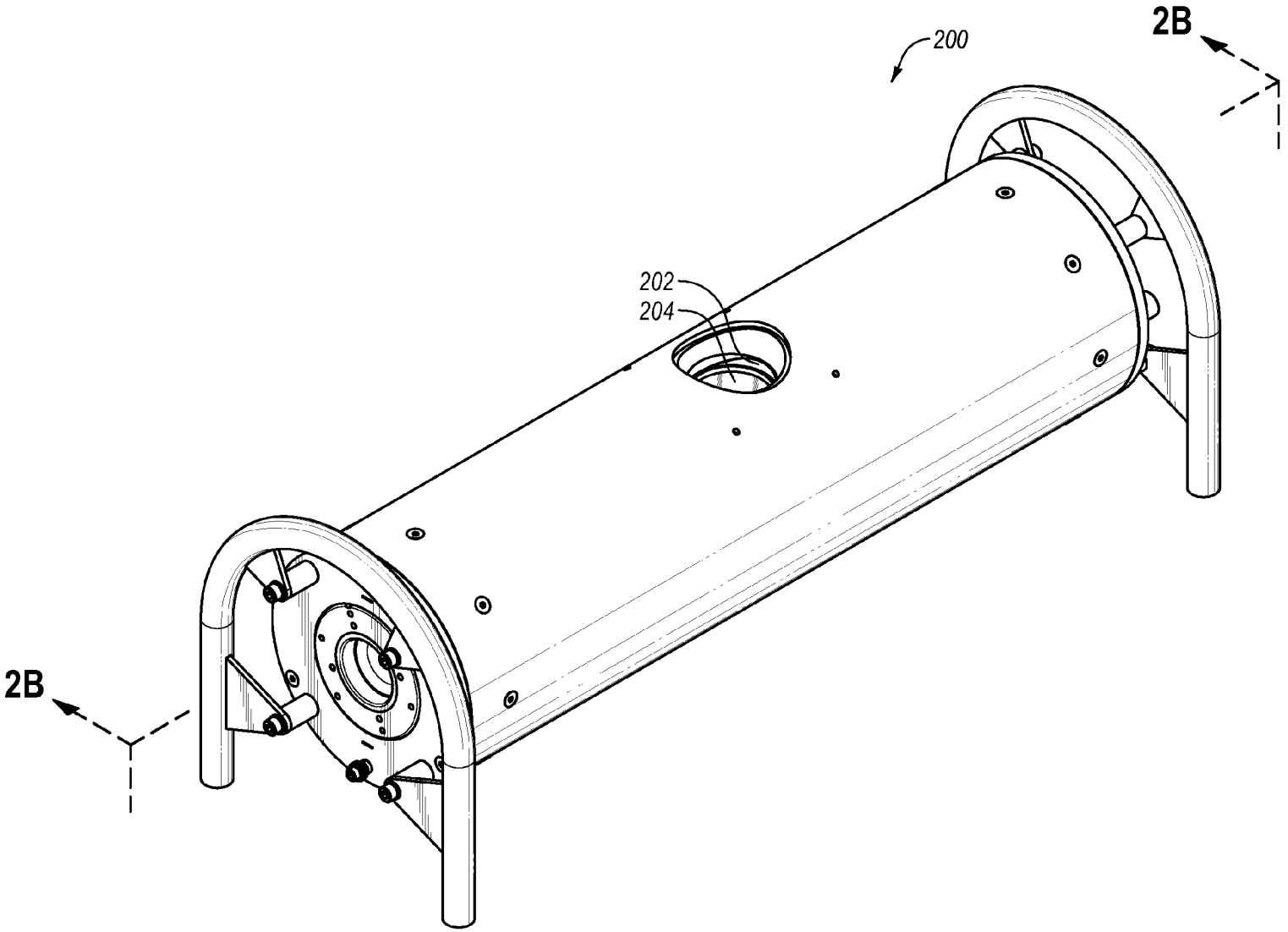
FIG. 2A is a perspective view of a second example x-ray tube.
Figure 2B:
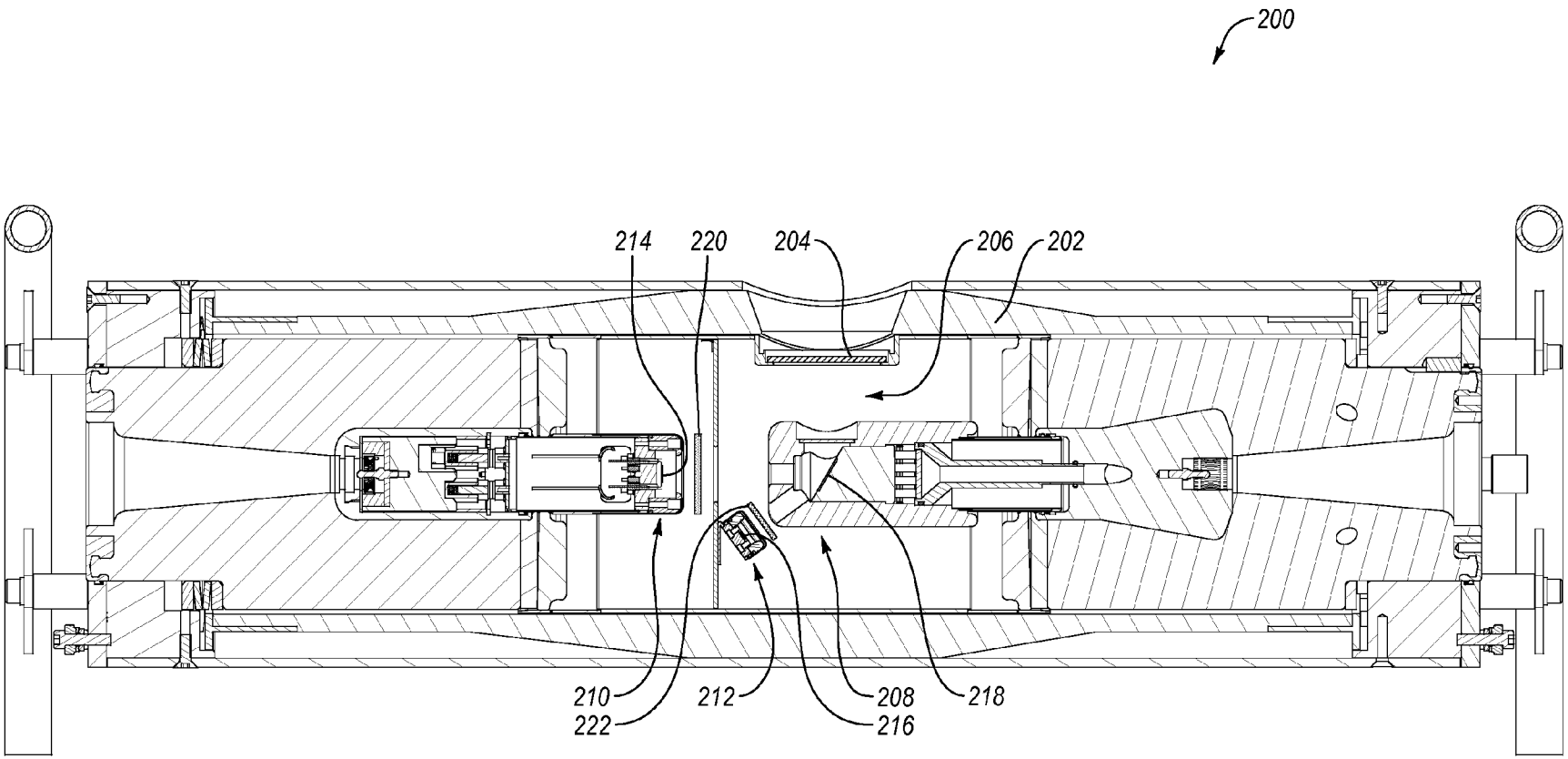
FIG. 2B is a cross-sectional side view of the second example x-ray tube of FIG. 2A.

With reference now to FIGS. 2A and 2B, a second example dual-energy x-ray tube 200 is disclosed. As disclosed in FIGS. 2A and 2B, the example dual-energy x-ray tube 200 includes a can 202 and an x-ray tube window 204, which at least partially define an evacuated enclosure 206 within which an anode 208, a first cathode 210, and a second cathode 212 are positioned. Similar to the configuration of the dual-energy x-ray tube 100, the anode 208 and the first cathode 210 are connected in a first electrical circuit that allows for the application of a first high voltage potential between the anode 208 and the first cathode 210 and the anode 208 and the second cathode 212 are connected in a second electrical circuit that allows for the application of a second high voltage potential between the anode 208 and the second cathode 212. In order to create x-rays at dual energies, the anode 208 is configured to operate at a positive high voltage, the first cathode 210 is configured to operate at a negative high voltage, and the second cathode 212 is configured to operate at about zero voltage. Thus, the anode 208 and the first cathode 210 are both electrically insulated from about ground, while the second cathode 212 is not electrically insulated from about ground and thus requires no high-voltage stand-off. The second example dual-energy x-ray tube 200 further includes grids 220 and 222 positioned within the evacuated enclosure 206 between the first and second emitters 214 and 216, respectively, and the anode 208.

The operation of the second example dual-energy x-ray tube 200 of FIGS. 2A and 2B is similar to the operation of the first example dual-energy x-ray tube of FIGS. 1A and 1B, except that during operation of the second example dual-energy x-ray tube 200 the grids 220 and 222 are configured to substantially allow electrons to reach the anode target surface 218 of the anode 208 from only the first emitter 214 or the second emitter 216 at any given time. For example, the dual-energy x-ray tube 200 may rapidly cycle between operation of the grid 220, which prevents the emission of electrons from the first emitter 214, and operation of the grid 222, which prevents the emission of electrons from the second emitter 216. In this manner, while both the emitters 214 and 216 are continuously operating, only electrons from one of the emitters 214 or 216 are reaching the anode 208 and producing x-rays at any given time. It is noted that cycling between the operation of the grids 220 and 222 requires significantly less energy than cycling between the operation of two cathodes that are each operating at a separate negative high-voltages. It is also noted that while the second cathode 212 is not electrically insulated from about ground and thus requires no high-voltage stand-off, the grid 222 may require some low voltage insulation isolation from ground.

The dual-energy x-ray tube 200 is therefore configured to consecutively generate x-rays at dual energies, with the energy of the x-rays produced by the first cathode 210 being higher than the energy of the x-rays produced by the second cathode 212. The dual-energy x-ray tube 200 can be employed in connection with an x-ray detector, such as a flat-panel detector, that is specifically designed to consecutively detect x-rays at each of the dual energies.

3. Other Example Dual-Energy X-Ray Tubes

Although the example dual-energy x-ray tubes 100 and 200 are depicted as stationary anode x-ray tubes, the example dual-energy x-ray configurations disclosed herein may alternatively be employed, for example, in rotatable anode dual-energy x-ray tubes. Also, while the example dual-energy x-ray tubes 100 and 200 are configured for use in baggage scanning applications, but it is understood that the dual-energy x-ray configurations disclosed herein can be employed in x-ray tubes configured for use in other applications including, but not limited to, other industrial or medical applications.

Further, while the example dual-energy x-ray tube 100 is disclosed in connection with FIG. 1B as not including any grid, it is understood that the example grids 220 and 222 disclosed in FIG. 2B could be employed in the example dual-energy x-ray tube 100 to enable the consecutive generation of x-rays at dual energies, or to alternate between consecutive generation and simultaneous generation of x-rays at dual energies. It is further understood that a single grid with multiple operational portions could be employed in place of the grids 220 and 222, where the operational portions can be cyclically activated and deactivated.

The example embodiments disclosed herein may be embodied in other specific forms. The example embodiments disclosed herein are therefore to be considered in all respects only as illustrative and not restrictive.

What is claimed is:

1. A duel-energy x-ray tube comprising:
an evacuated enclosure;
an anode positioned within the evacuated enclosure;
an electron target inside the anode;
a first electron passageway and a second electron passageway extending through the anode, the first electron passageway defining a portion of a first electron path to the electron target and the second electron passageway defining a portion of a second electron path to the electron target;
a first cathode positioned within the evacuated enclosure and configured to emit electrons towards the electron target for passage through the first electron passageway extending through the anode, wherein the first cathode is electrically insulated from about ground; and
a second cathode positioned within the evacuated enclosure and configured to emit electrons towards the electron target for passage through the second electron passageway extending through the anode, wherein the second cathode is electrically coupled to about ground,
wherein the first cathode and the second cathode are configured to operate simultaneously at different voltages.

2. The dual-energy x-ray tube as recited in claim 1, wherein:
the anode configured to operate at a positive high voltage;
the first cathode configured to operate at a negative high voltage; and
the second cathode configured to operate at about zero voltage.

3. The dual-energy x-ray tube as recited in claim 2, wherein:
the anode is configured to operate between 50 kV and 320 kV; and
the first cathode is configured to operate between −50 kV and −320 kV.

4. The dual-energy x-ray tube as recited in claim 1, wherein an operation state of the second cathode results in x-rays that are about half the energy of the x-rays that result from an operation state of the first cathode.

5. The dual-energy x-ray tube as recited in claim 1, wherein an operation state of the second cathode results in x-rays that have an energy that is greater than or less than half the energy of the x-rays that result from an operation state of the first cathode.

6. The dual-energy x-ray tube as recited in claim 1, wherein the first cathode includes a first cathode emitter and the second cathode includes a second cathode emitter, and the dual-energy x-ray tube further comprising one or more grids positioned within the evacuated enclosure between the first and second cathode emitters and the anode, wherein the one or more grids are configured to substantially allow electrons to reach the electron target of the anode from only the first cathode emitter or the second cathode emitter at any given time.

7. A dual-energy x-ray tube comprising:
an evacuated enclosure;
an anode positioned within the evacuated enclosure;
an electron target inside the anode, wherein the anode is structured to include a first opening defining a portion of a first electron path to the electron target and a second opening defining a portion of a second electron path to the electron target;
a first cathode positioned within the evacuated enclosure and configured to emit electrons towards the electron target for passage through the first opening of the anode, the first cathode configured to operate at a negative high voltage; and
a second cathode positioned within the evacuated enclosure and configured to emit electrons towards the electron target for passage through the second opening of the anode, the second cathode configured to operate at about zero voltage, wherein the first cathode and the second cathode are configured to continuously operate simultaneously.

8. The dual-energy x-ray tube as recited in claim 7, wherein:

the anode is configured to operate between 50 kV and 320 kV; and the first cathode is configured to operate between −50 kV and −320 kV.

9. The dual-energy x-ray tube as recited in claim 8, wherein an operation state of the second cathode results in x-rays that are about half the energy of the x-rays that result from an operation state of the first cathode.

10. The dual-energy x-ray tube as recited in claim 8, wherein an operation state of the second cathode results in x-rays that have an energy that is greater than or less than half the energy of the x-rays that result from an operation state of the first cathode.

11. The dual-energy x-ray tube as recited in claim 7, wherein:

the first cathode is electrically insulated from about ground; and the second cathode is not electrically insulated from about ground.

12. The dual-energy x-ray tube as recited in claim 7, wherein the first cathode and the second cathode are configured to generate x-rays at dual energies simultaneously.

13. The dual-energy x-ray tube as recited in claim 7, wherein the first cathode includes a first cathode emitter and the second cathode includes a second cathode emitter, and the dual-energy x-ray tube further comprising one or more grids positioned within the evacuated enclosure between the first and second cathode emitters and the anode, wherein the one or more grids are configured to substantially allow electrons to reach the electron target of the anode from only the first cathode emitter or the second cathode emitter at any given time.

14. A dual-energy x-ray system comprising:

a high-voltage generator configured to continuously generate a single positive high voltage and a single negative high voltage;

an x-ray tube comprising:

an evacuated enclosure;

an anode positioned within the evacuated enclosure;

an electron target inside the anode;

a first electron passageway extending through the anode and defining a portion of a first electron path to the electron target and a second electron passageway extending through the anode and defining a portion of a second electron path to the electron target positioned inside the anode;

a first cathode positioned within the evacuated enclosure and configured to emit electrons towards the electron target for passage through the first electron passageway that extends through the anode, the first cathode configured to operate at the single negative high voltage; and a second cathode positioned within the evacuated enclosure and configured to emit electrons towards the electron target for passage through the second electron passageway that extends through the anode, the second cathode configured to operate at about zero voltage, wherein the first cathode and the second cathode are configured to continuously operate simultaneously.

15. The dual-energy x-ray system as recited in claim 14, wherein the high-voltage generator is configured to continuously generate the single positive high voltage between 50 kV and 320 kV and the single negative high voltage between −50 kV and −320 kV.

16. The dual-energy x-ray system as recited in claim 14, wherein the high-voltage generator is balanced such that the single positive high voltage is about opposite the single negative high voltage.

17. The dual-energy x-ray system as recited in claim 14, wherein the high-voltage generator is unbalanced such that the single positive high voltage is not opposite the single negative high voltage.

18. The dual-energy x-ray system as recited in claim 14, wherein the first cathode and the second cathode are configured to generate x-rays at dual energies simultaneously.

19. The dual-energy x-ray system as recited in claim 14, wherein the first cathode includes a first cathode emitter and the second cathode includes a second cathode emitter, and the x-ray tube further comprising one or more grids positioned within the evacuated enclosure between the first and second cathode emitters and the anode, wherein the one or more grids are configured to substantially allow electrons to reach the electron target of the anode from only the first cathode emitter or the second cathode emitter at any given time.

* * * * *